US005117637A

United States Patent [19]

Howell et al.

[11] Patent Number: 5,117,637

[45] Date of Patent: Jun. 2, 1992

[54] COMBUSTOR DOME ASSEMBLY

[75] Inventors: Stephen J. Howell, Georgetown; Steven M. Toborg, Lynn, both of Mass.; Grant A. Albert, Oak Park, Ill.

[73] Assignee: General Electric Company, Lynn, Mass.

[21] Appl. No.: 562,282

[22] Filed: Aug. 2, 1990

[51] Int. Cl.[5] ..... F23R 3/14

[52] U.S. Cl. ..... 60/748; 60/740

[58] Field of Search ..... 60/748, 737, 740, 743, 60/734, 756; 239/DIG. 7

[56] References Cited

U.S. PATENT DOCUMENTS

| | | | |
|---|---|---|---|
| 3,589,127 | 6/1971 | Kenworthy et al. | 60/39.37 |
| 3,834,159 | 10/1974 | Vdoviak | 60/749 |
| 3,853,273 | 12/1974 | Bahr et al. | 60/748 |
| 3,899,884 | 8/1975 | Ekstedt | 60/39.74 |
| 3,946,552 | 3/1976 | Weinstein et al. | 60/748 |
| 4,180,974 | 1/1980 | Stenger et al. | 60/756 |
| 4,198,815 | 4/1980 | Bobo et al. | 60/748 |
| 4,843,825 | 7/1989 | Clark | 60/756 |
| 4,870,818 | 10/1989 | Suliga | 60/740 |
| 4,934,145 | 6/1990 | Zeisser | 60/756 |
| 4,974,416 | 12/1990 | Taylor | 60/748 |
| 4,999,996 | 3/1991 | Duchere et al. | 60/740 |

FOREIGN PATENT DOCUMENTS

| | | |
|---|---|---|
| 2193141 | 2/1974 | France . |
| 2235274 | 1/1975 | France . |
| 2312654 | 12/1976 | France . |
| 2134243 | 8/1984 | United Kingdom . |

OTHER PUBLICATIONS

Reba, I. "Application of the Coanda Effect," Scientific American (Jun., 1966).

*Primary Examiner*—Richard A. Bertsch
*Assistant Examiner*—Timothy S. Thorpe
*Attorney, Agent, or Firm*—Nathan D. Herkamp; Jerome C. Squillaro

[57] ABSTRACT

A gas turbine engine combustor dome assembly includes a dome having a dome eyelet, a mounting ring fixedly joined to the dome around the eyelet, a baffle fixedly joined to the mounting ring, and a carburetor fixedly joined to the mounting ring. The carburetor is joined to the mounting ring for providing a fuel/air mixture through the mounting ring with a predetermined relationship to the baffle for controlling pattern factor. The mounting ring allows for assembly with reduced stackup clearances, and easy disassembly for servicing.

29 Claims, 8 Drawing Sheets

COMBUSTOR DOME ASSEMBLY

TECHNICAL FIELD

The present invention relates generally to gas turbine engine combustors, and, more specifically, to an improved combustor dome assembly.

BACKGROUND ART

A conventional gas turbine engine combustor includes radially spaced outer and inner combustor liners joined at an upstream end thereof by a dome assembly. The dome assembly includes a plurality of circumferentially spaced carburetors therein, with each carburetor including a fuel injector for providing fuel and an air swirler for providing swirled air for mixing with the fuel for creating a fuel/air mixture discharged into the combustor between the two liners. The mixture is conventionally burned for generating combustion gases which flow downstream through the combustor to a conventional turbine nozzle suitably joined to the downstream end of the combustor. Immediately downstream of the turbine nozzle is a conventional high-pressure turbine which extracts energy from the combustion gases for powering a compressor disposed upstream of the combustor which provides compressed air to the air swirlers.

A significant performance consideration for the combustor is the conventionally known pattern factor which is a nondimensional factor indicative of temperature distribution to the turbine nozzle. The pattern factor may be defined as the maximum temperature of the combustion gases at the combustor outlet minus the average temperature thereof divided by the average outlet temperature minus the temperature of the compressed air at the inlet to the combustor. The pattern factor indicates the relative uniformity of combustion gas temperature experienced by the turbine nozzle from the combustor outlet, with an ideal pattern factor of zero indicating uniform temperature.

In one conventional gas turbine engine combustor, it was desirable to increase the combustor outlet temperature for increasing power output from the gas turbine engine. Although the pattern factor for the increased power combustor was the same as the original combustor, the increased maximum combustor outlet temperature would have led to a reduction in turbine life. Accordingly, modifying the original combustor for reducing pattern factor was desired for improving turbine life.

Accordingly, a conventional air swirler known to have a relatively low pattern factor was scaled down from an engine having a dome height of about two and one-half inches (about six centimeters) for the above combustor having a dome height of about one and one-half inches (about four centimeters). The air swirler from the original combustor and the one to be used as a replacement air swirler were both conventional counterrotational air swirlers, the former having a primary venturi throat diameter of about two-thirds that of the latter. However, it was determined analytically that simple scaling down of the low pattern factor air swirler could not result in similar low pattern factor in the original combustor since the original manufacturing tolerances were already at a minimum of about 1 mil. In view of the relatively small size of the original combustor, manufacturing tolerances prevented the attainment of the required relatively low pattern factor for improving life of the combustor and the turbine. The original combustor had a particular, or first reference pattern factor, and the replacement air swirler having a smaller, or second reference pattern factor in its larger size application would have been unable to attain significantly reduced pattern factor in the smaller combustor size.

Another significant consideration in the design of the gas turbine engine combustor is serviceability of the life-limiting parts therein. For example, the dome assembly includes a conventional baffle extending from the air swirler and spaced from the combustor dome for providing a channel therebetween for channeling compressor air for cooling at least the baffle itself. The baffle provides a heat shield between the combustion occurring immediately downstream of the air swirler for protecting the dome. Accordingly, it is one life-limiting part which is replaced at periodic intervals.

The baffle is typically welded and/or brazed to the dome and typically requires replacement of the entire dome assembly therewith or substantial disassembly work at the periodic service intervals. Such baffle replacement service is relatively expensive and requires a significant amount of time.

OBJECTS OF THE INVENTION

Accordingly, one object of the present invention is to provide a new and improved dome assembly for a gas turbine engine combustor.

Another object of the present invention is to provide a dome assembly effective for obtaining relatively low pattern factor.

Another object of the present invention is to provide a dome assembly effective for obtaining low pattern factor in a relatively small combustor.

Another object of the present invention is to provide a dome assembly having individually replaceable baffles.

DISCLOSURE OF INVENTION

A gas turbine engine combustor dome assembly includes a dome having a dome eyelet, a mounting ring fixedly joined to the dome around the eyelet, a baffle fixedly joined to the mounting ring, and a carburetor fixedly joined to the mounting ring. The carburetor is joined to the mounting ring for providing a fuel/air mixture through the mounting ring with a predetermined relationship to the baffle for controlling pattern factor.

BRIEF DESCRIPTION OF DRAWINGS

The novel features believed characteristic of the invention are set forth and differentiated in the claims. The invention, in accordance with a preferred, exemplary embodiment, together with further objects and advantages thereof, is more particularly defined in the following detailed description taken in conjunction with the accompanying drawing in which:

MODE(S) FOR CARRYING OUT THE INVENTION

Figure 1:
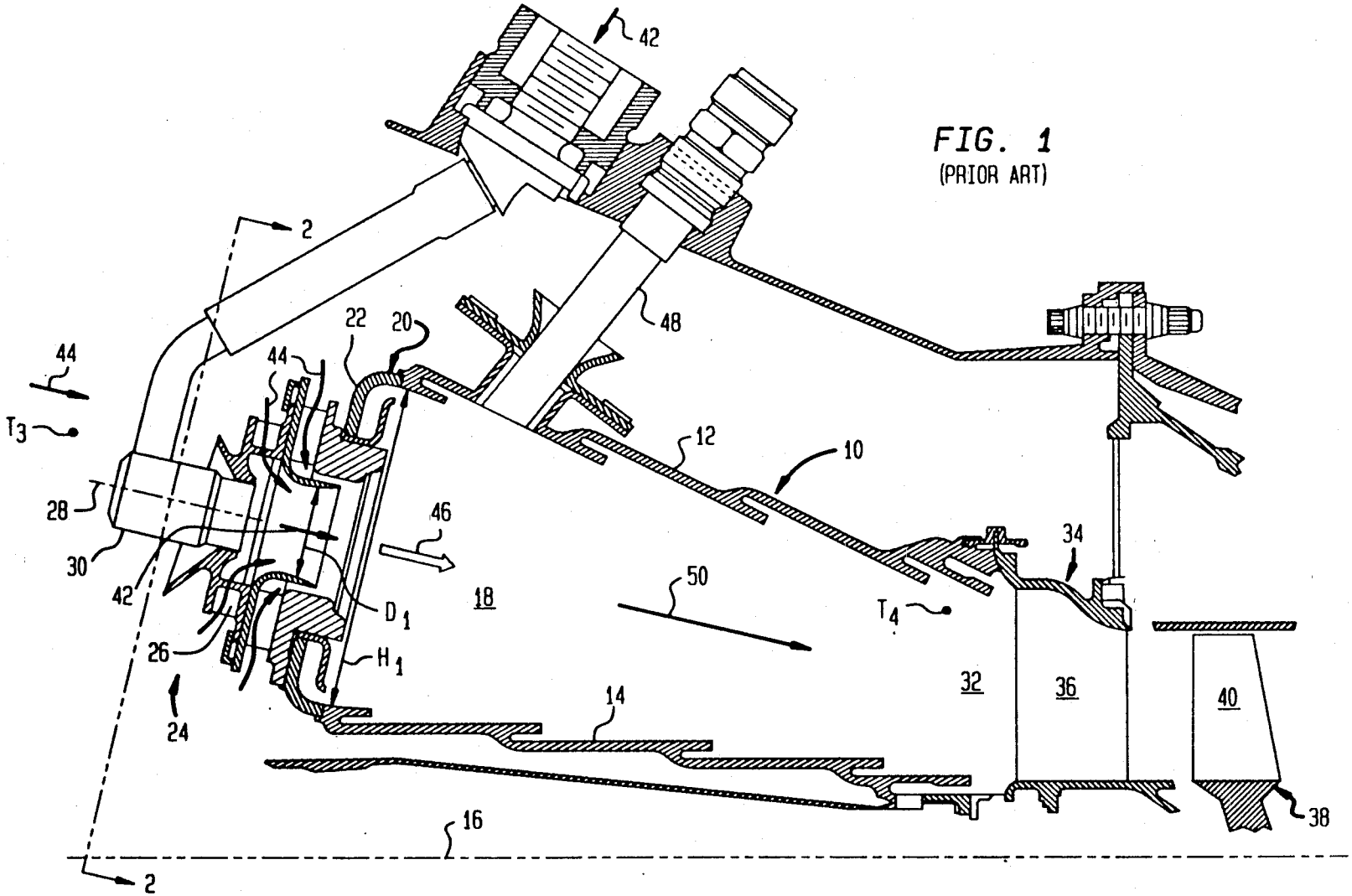
FIG. 1 (PRIOR ART)
FIG. 1 is a centerline sectional view of a prior art gas turbine engine combustor assembly and adjacent structure.
Figure 2:
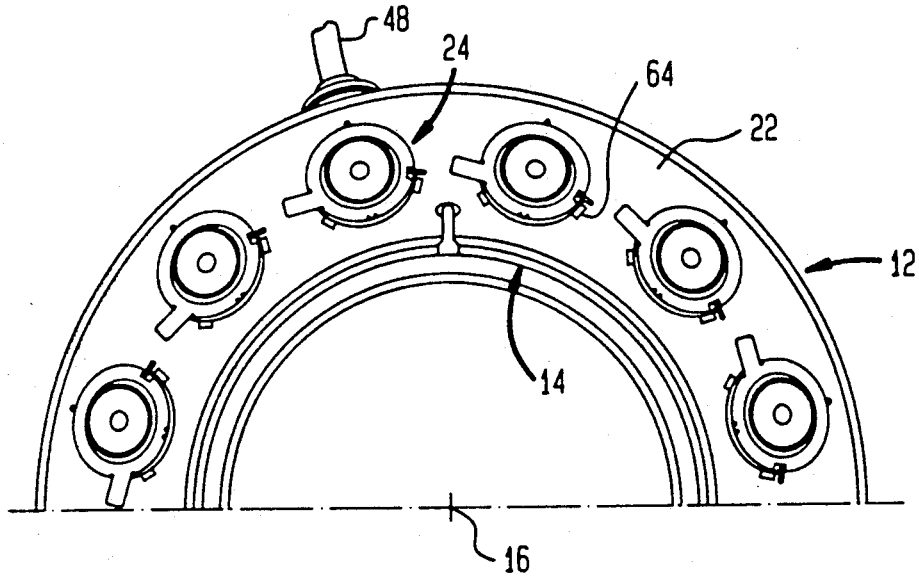
FIG. 2 (PRIOR ART)
FIG. 2 is a downstream facing end view of the dome assembly of the combustor illustrated in FIG. 1 taken along line 2—2.

Illustrated in FIG. 1 is an exemplary, prior art gas turbine engine combustor 10. The combustor 10 includes a pair of conventional, film-cooled radially outer and inner annular liners 12 and 14 disposed coaxially about a longitudinal centerline axis 16 of the combustor 10 and the gas turbine engine. The liners 12 and 14 are spaced from each other to define therebetween a conventional combustion zone 18. At its upstream end, the combustor 10 includes a conventional dome assembly 20 which includes an annular dome plate 22 disposed coaxially about the centerline axis 16 which is conventionally fixedly connected to upstream ends of the liners 12 and 14. The assembly 20 includes a plurality of conventional, circumferentially spaced carburetors 24, which are additionally shown in FIG. 2. Each of the carburetors 24 includes a conventional counterrotational air swirler 26 having a longitudinal centerline axis 28. The carburetor 24 also includes a conventional fuel injector 30 disposed coaxially with the centerline axis 28.

The combustor 10 includes at its aft end an annular outlet 32 and is conventionally connected to a conventional turbine nozzle 34 which includes a plurality of circumferentially spaced nozzle vanes 36. Disposed downstream from the nozzle 34 is a conventional high-pressure turbine (HPT) 38 including a plurality of circumferentially spaced blades 40.

In operation, fuel 42 is conventionally channeled through the injector 30 and discharged therefrom into the swirler 26 wherein it is mixed with a portion of compressed air 44 conventionally provided to the combustor 10 from the conventional compressor (not shown). The swirler 26 is effective for mixing the fuel 42 and the air 44 for creating a fuel/air mixture 46 which is discharged into the combustion zone 18 where it is conventionally ignited by a conventional igniter 48 disposed in the outer liner 12. Combustion gases 50 are generated and are channeled from the combustion zone 18 to the combustor outlet 32, to the turbine nozzle 34, and then to the HPT 40 which extracts energy therefrom for powering the compressor disposed upstream of the combustor 10.

As described above in the Background Art section, the combustor 10 in this exemplary embodiment is an existing design for a particular application wherein the combustor 10 has a dome height $H_1$ of about one and one-half inches (about four centimeters), and a correspondingly smaller primary venturi diameter $D_1$ in the swirler 26. The original carburetor 24 provides acceptable performance and acceptable life of the combustor 10 and the HPT 38 for a particular power level. However, in upgrading the engine including the combustor 10, the temperature of the combustion gases 50 at the outlet 32, designated $T_4$, is correspondingly increased for providing more energy therefrom for providing more output power from the engine. The pattern factor associated with the combustor 10, which is defined as the maximum exit temperature of $T_4$ minus the average exit temperature of $T_4$ divided by the average temperature of $T_4$ minus the temperature at the inlet to the combustor, which is designated $T_3$ for the temperature of the compressed air 44, has a particular value designated herein as the first reference pattern factor. Although the pattern factor remains substantially the same as the combustor outlet temperature $T_4$ is increased, the increased outlet temperature $T_4$ would lead to a decrease in life of the liners 12 and 14 and the turbine 38, for example.

Figure 3:
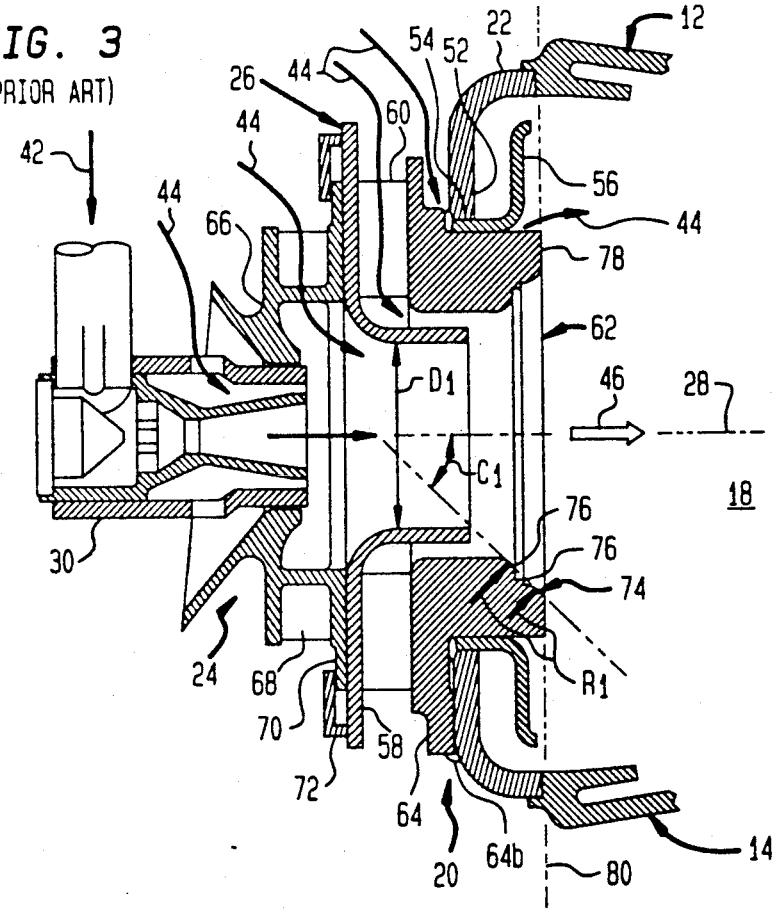
FIG. 3 (PRIOR ART)
FIG. 3 is an enlarged centerline sectional view of the prior art dome assembly illustrated in FIG. 1.

Illustrated in FIG. 3 is an enlarged sectional view of the prior art carburetor 24 illustrated in FIG. 1. The dome 22 includes an annular dome eyelet 52 which defines an annular eyelet opening 54. A conventional baffle 56 is conventionally fixedly attached to the eyelet 52 through the opening 54 by tack welding and brazing. The swirler 26 includes a septum 58, defining the primary venturi having the diameter $D_1$, a plurality of circumferentially spaced aft swirl vanes 60, and an annular exit cone 62, all formed together in an integral casting. The exit cone 62 includes three circumferentially spaced mounting tabs 64, also shown in FIG. 2, which are welded to the dome 22 at welds 64*b* for supporting the exit cone 62 against the dome 22 and the baffle 56.

The swirler 26 also includes a conventional ferrule 66 for slidably supporting the fuel injector 30 therein, and includes a plurality of circumferentially spaced forward swirl vanes 68 and an annular radial flange 70 attached thereto. The radial flange 70 is radially slidably attached to the septum 58 by conventional tabs 72.

The exit cone 62 includes a flow surface 74 which in transverse section as illustrated in FIG. 3 is inclined generally along a line disposed at an acute cone angle $C_1$ relative to the centerline axis 28. The flow surface 74 includes two axially spaced annular recesses 76 defined by two generally equal radii $R_1$ at the flow surface 74 in the transverse plane. The exit cone 62 includes a radially extending flat aft surface 78 forming a portion of the flow surface 74. The dome 22 at the eyelet 52, the baffle 56, and the cone aft surface 78 are aligned generally parallel to a radial axis 80 for forming a generally flat dome 22.

The prior art dome assembly 20 illustrated in FIG. 3 is effective for providing a relatively narrow discharge spray cone of the fuel/air mixture 46 into the combustion zone 18. This provides acceptable performance for the original design application but is determined to be undesirable for the combustor 10 having the increased outlet temperature $T_4$ described above since it provides for recirculation of the combustion gases 50 adjacent to the dome 22 which adversely affects the pattern factor and combustor life.

Figure 4:
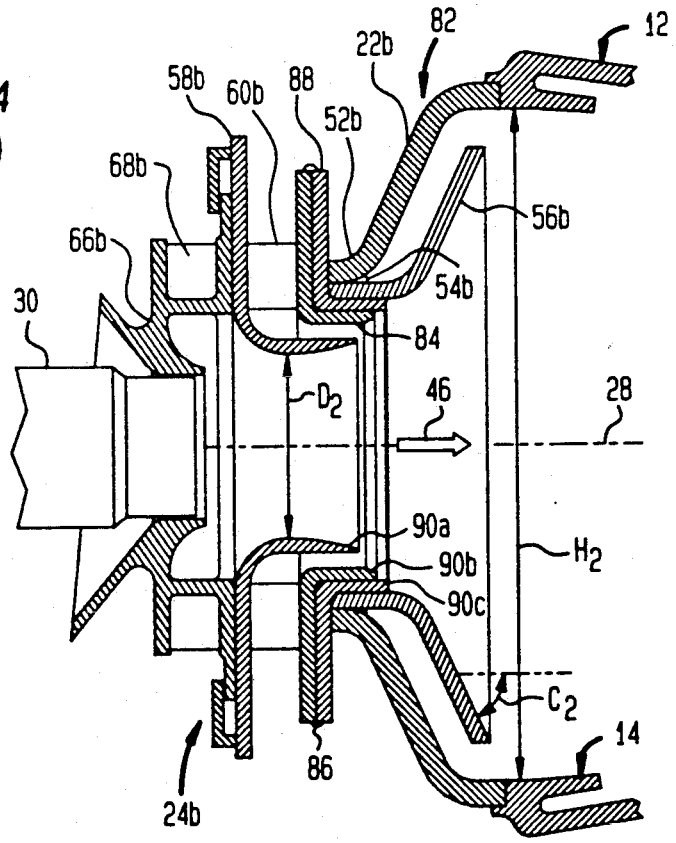
FIG. 4 (PRIOR ART)
FIG. 4 is an enlarged centerline sectional view of an alternate embodiment of a prior art dome assembly scaled in size for application in the combustor illustrated in FIG. 1.

Illustrated in FIG. 4 is a second prior art dome assembly 82 known to have a relatively low pattern factor designated herein as the second reference pattern factor, which is less than the first reference pattern factor for the combustor 10 illustrated in FIG. 1. The second dome assembly 82 was provided from an existing combustor design having a dome height $H_2$ of about two and one-half inches (about six centimeters) and a corresponding primary venturi diameter $D_2$, which are both larger than those associated with the combustor 10 illustrated in FIG. 1. Accordingly, the second dome assembly 82 was scaled down for direct replacement in the combustor 10 illustrated in FIG. 1.

The second dome assembly 82 illustrated in FIG. 4 is a scaled down version for use in the particularly sized combustor 10 illustrated in FIG. 1 and includes a carburetor generally similar to the carburetor 24 illustrated in FIGS. 1 and 3, which is designated **24*b*. Analogous components between the carburetor 24 illustrated in FIG. 3 and the carburetor 24*b* illustrated in FIG. 4 have been designated with the letter b and include a ferrule 66*b*, forward swirl vanes 68*b*, septum 58*b*, aft swirl vanes 60*b*, dome 22*b*, dome eyelet 52*b*, dome eyelet opening 54*b*, and baffle 56*b*. In this embodiment, however, instead of the cast relatively large exit cone 62 illustrated in FIG. 3, the aft swirl vanes 60*b* illustrated in FIG. 4 are fixedly joined to a generally L-shaped annular exit member 84**.

The exit member 84 is tack welded at four circumferentially spaced locations 86 to an annular L-shaped mounting bushing 88 which is welded and/or brazed to the dome eyelet **52*b*. The mating surfaces of the members 84 and 88 are machined surfaces for reducing leakage therebetween. The baffle 56*b* is sandwiched between the bushing 88 and the dome eyelet 52*b* in the eyelet opening 54 and is tack welded and brazed therein. The septum 58*b*, exit member 84, and bushing 88 have aft ends 90*a*, 90*b*, and 90*c*, respectively. The aft ends 90*b* and 90*c* are generally aligned along an arc with the baffle 56*b*, with the aft end 90*a* being disposed upstream thereof. The downstream end of the baffle 56*b* is also straight in transverse section and is inclined at an acute angle $C_2$ relative to the centerline axis 28**.

The second dome assembly 82 illustrated in FIG. 4 is a fabricated and assembled structure subject to manufacturing tolerances and stackup tolerances. In the relatively small size required for use in the FIG. 1 combustor 10 having the dome height $H_1$, the manufacturing tolerances and stackup tolerances would be relatively large, resulting in substantial variability of the several carburetors **24*b* utilized. As a result, the pattern factor for the combustor 10 if built for utilizing the carburetor 24*b* would not have been lower than the first reference pattern factor of the original combustor 10 and would have been unacceptable for obtaining acceptable life of the combustor 10 and the turbine 38**.

Figure 7:
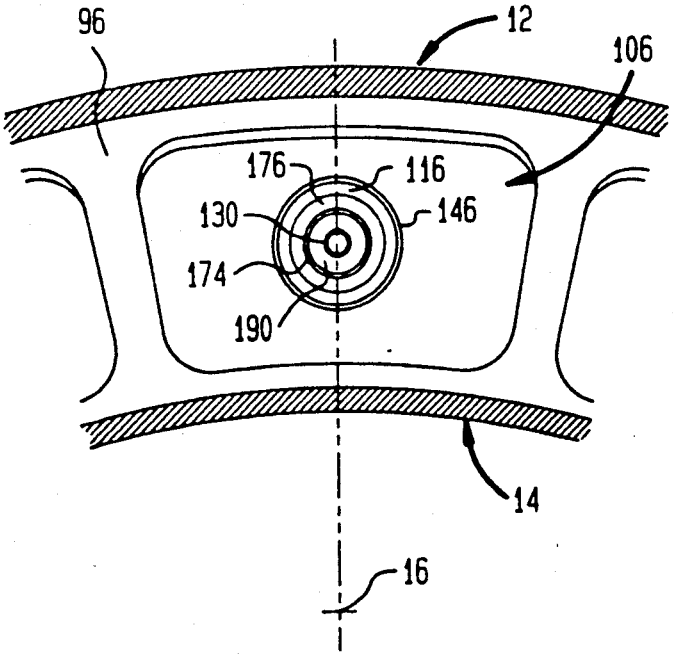
FIG. 7 is an upstream facing end view of the dome assembly illustrated in FIG. 6 taken along line 7—7.
Figure 5:
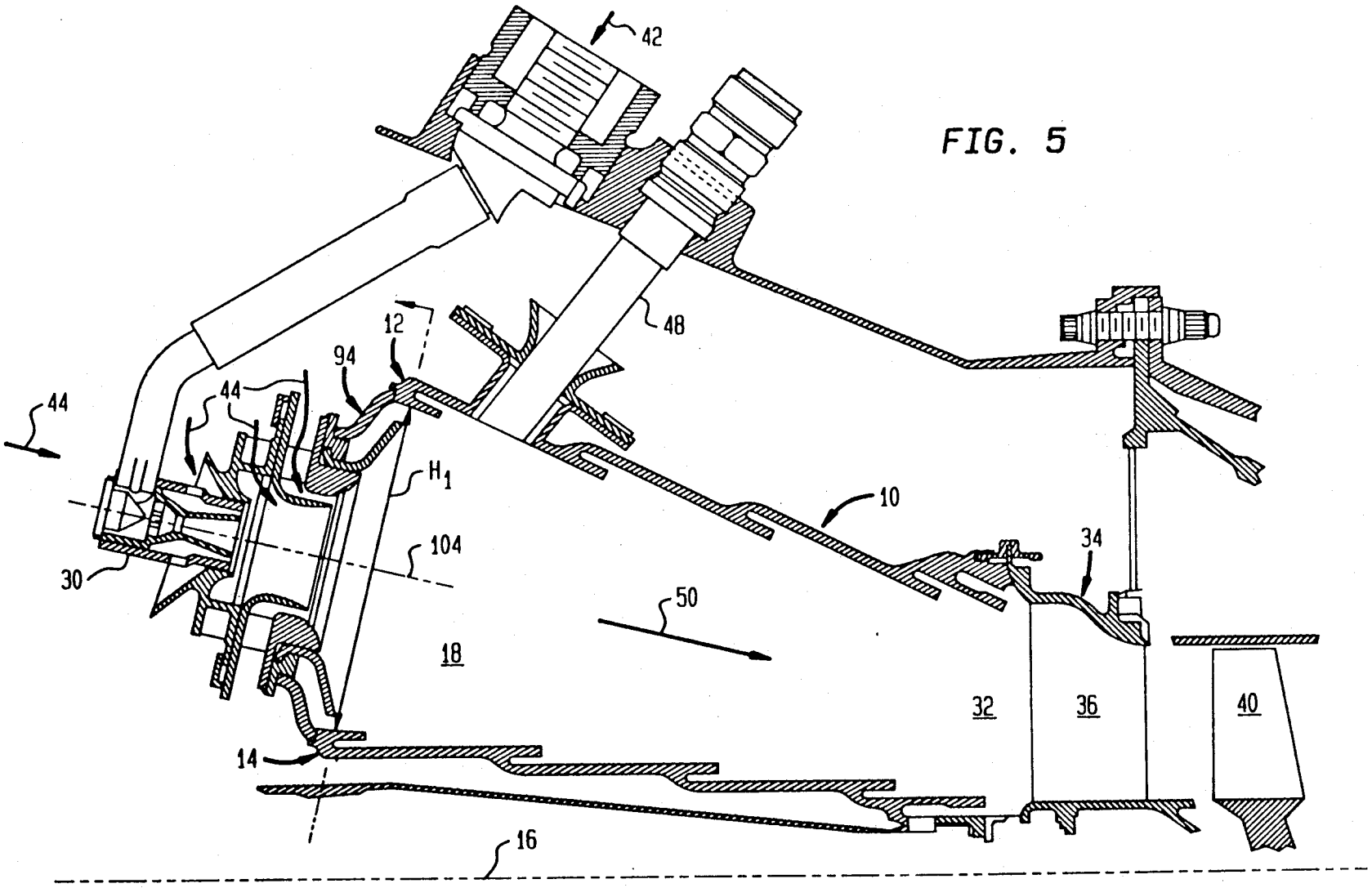
FIG. 5 is a centerline sectional view of a dome assembly in accordance with one embodiment of the present invention applied to the combustor illustrated in FIG. 1.
Figure 6:
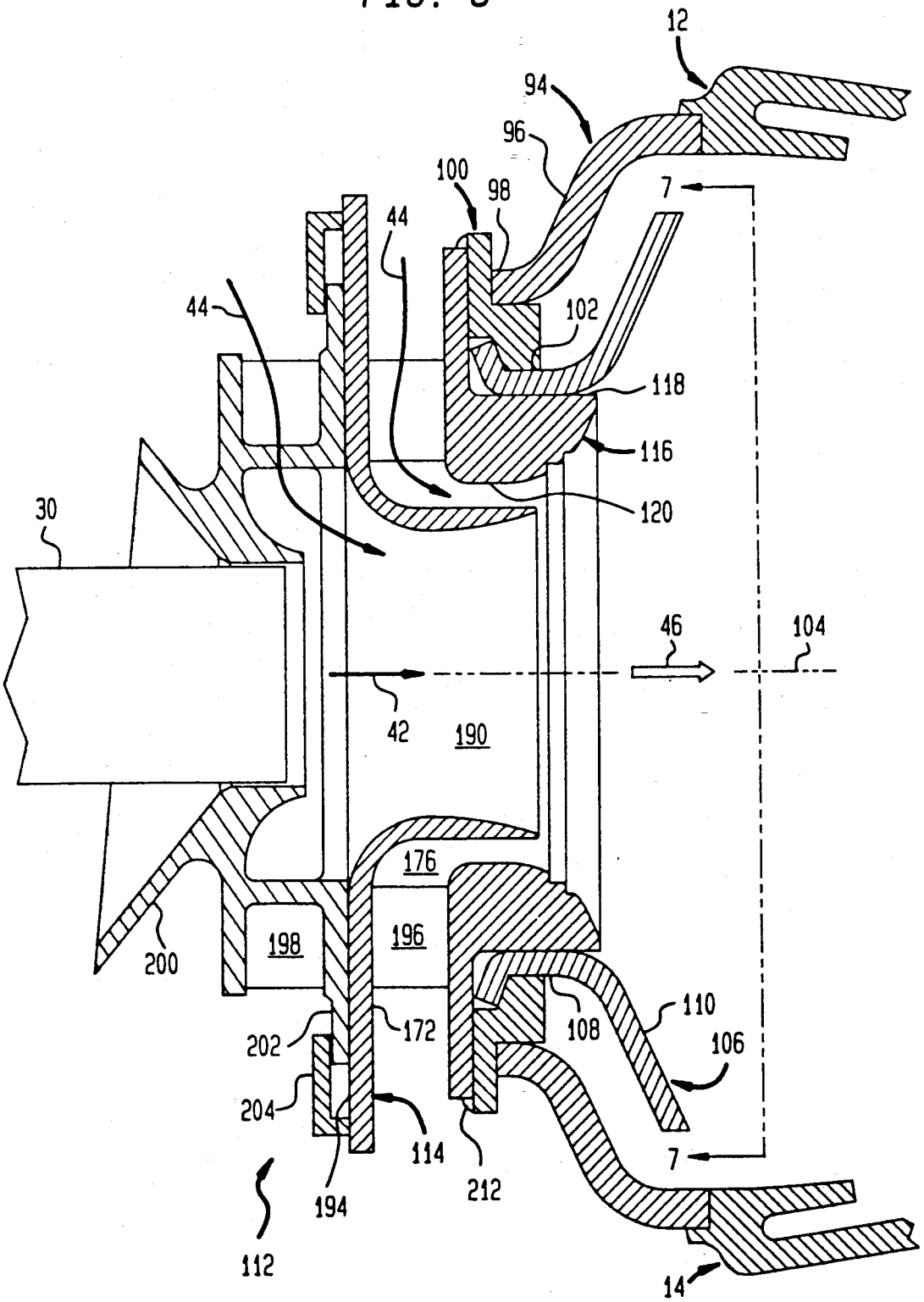
FIG. 6 is an enlarged centerline sectional view of the dome assembly illustrated in FIG. 5.

Illustrated in FIGS. 5 and 6 is one embodiment of a dome assembly 94 in accordance with the present invention. In this embodiment, the dome assembly 94 is sized for use in the preexisting combustor 10 illustrated in FIG. 1 and has the dome height $H_1$. The dome assembly 94 includes an annular dome 96 disposed coaxially about the engine centerline axis 16 and includes a plurality of circumferentially spaced annular dome eyelets 98, as illustrated more particularly in FIG. 6. The assembly 94 also includes a plurality of annular mounting rings 100 each fixedly joined to a respective dome eyelet 98 of the dome 96 by welding or brazing, for example. The mounting ring 100 includes a central aperture 102 coaxially aligned with a respective dome eyelet 98 about a centerline axis 104. A plurality of baffles 106, also shown in FIG. 7, are disposed with respective ones of the eyelets 98. Each baffle 106 includes a tubular mounting portion 108 extending upstream through the aperture 102 and fixedly joined to the mounting ring 100, and a flare portion 110 extending downstream from the mounting ring 100.

The assembly 94 also includes a plurality of carburetors 112 each fixedly joined to a respective one of the mounting rings 100 for providing the fuel/air mixture 46 through the aperture 102 with a predetermined relationship to the baffle flare portion 110 for obtaining a relatively low pattern factor as described hereinbelow.

Each carburetor 112 includes an air swirler 114 having an annular exit cone 116 disposed symmetrically about the longitudinal centerline axis 104 thereof. The exit cone 116 includes a radially outer surface 118 disposed against the baffle mounting portion 108, and a radially inwardly facing annular flow surface 120 for channeling a portion of the air 44 thereover and downstream over the baffle flare portion 110. More specifically, the air 44 channeled over the flow surface 120 mixes with the fuel 42 provided by the fuel injector 30 and the fuel/air mixture 46 is dispersed radially outwardly and flows over the baffle flare portion 110.

Figure 8:
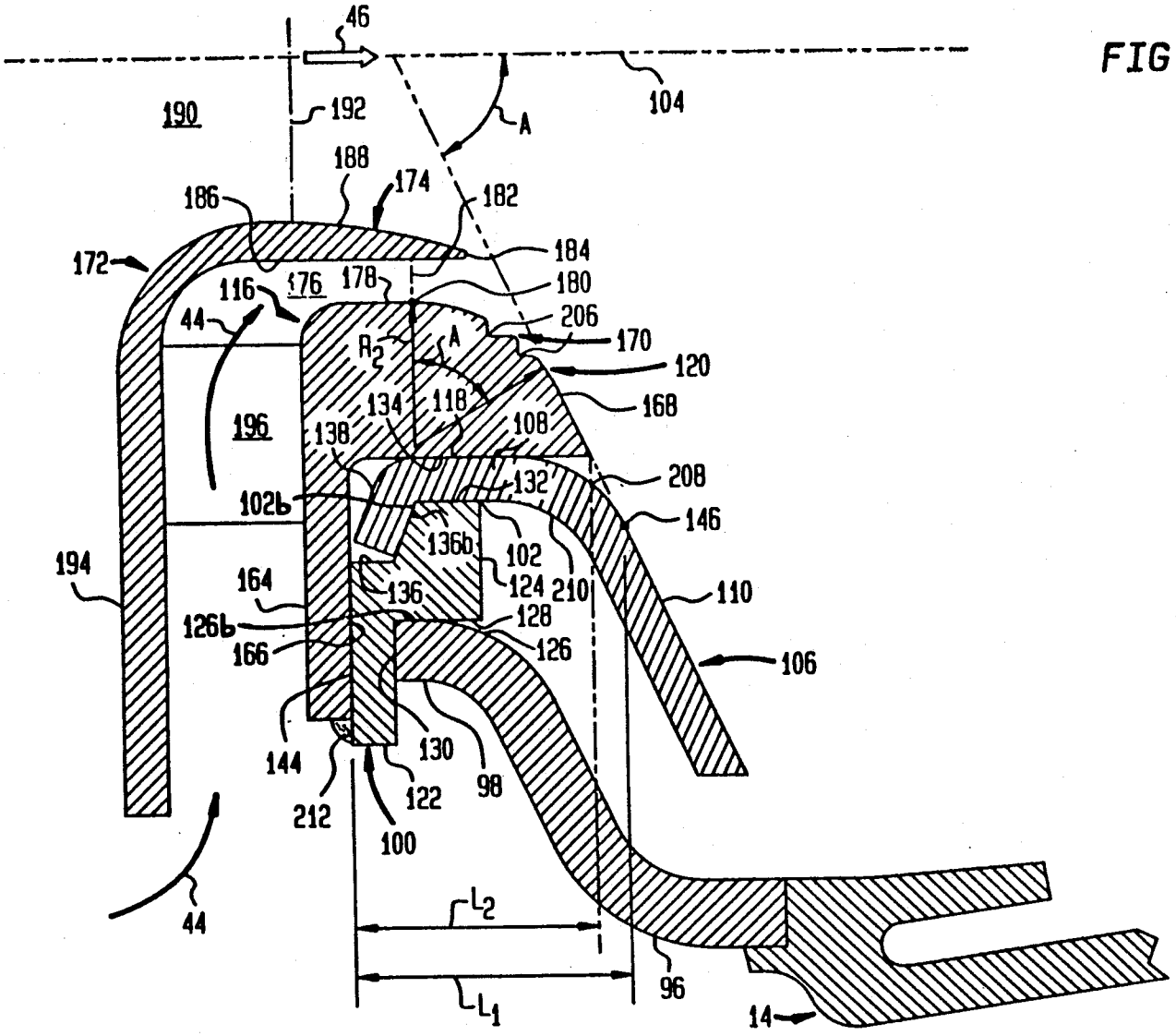
FIG. 8 is an enlarged centerline sectional view of a radially inner portion of the dome assembly illustrated in FIG. 6.

As illustrated more particularly in FIG. 8, the mounting ring 100 includes an annular radially outwardly extending radial flange 122 fixedly joined to the dome 96 around the dome eyelet 98 by welding or brazing, for example. The ring 100 also includes an annular axial flange 124 extending downstream from the radial flange 122 and being integral therewith, the axial flange 124 extending through a dome eyelet opening 126. The axial flange 124 includes a radially outer surface 128, which abuts the dome eyelet 98 at the opening 126, and a radially inner surface **102*b* which defines the central aperture 102. The dome eyelet 98 includes an annular radial side surface 130, and an annular axial inner surface 126*b* defining the eyelet opening 126**.

The baffle mounting portion 108 includes an annular radially outer surface 132 fixedly connected to the mounting ring inner surface **102*b*, and a radially inner surface 134 disposed against the exit cone outer surface 118 for providing a pilot surface for centering the swirler 114**, and for restricting any leaking airflow.

In the preferred embodiment, the mounting ring 100 also includes an annular recess 136 extending radially outwardly at a juncture of the ring radial and axial flanges 122 and 124, and the baffle mounting portion 108 has an upstream end 138 which is bent by swaging to be inclined radially outwardly into the recess 136 for providing one means for joining the baffle 106 to the mounting ring 100. This arrangement provides a significant advantage in accordance with the present invention for ease of assembly and disassembly and for obtaining preferred orientation of the baffle flare portion 110 relative to the exit cone 116 as further described hereinbelow.

Figure 9:
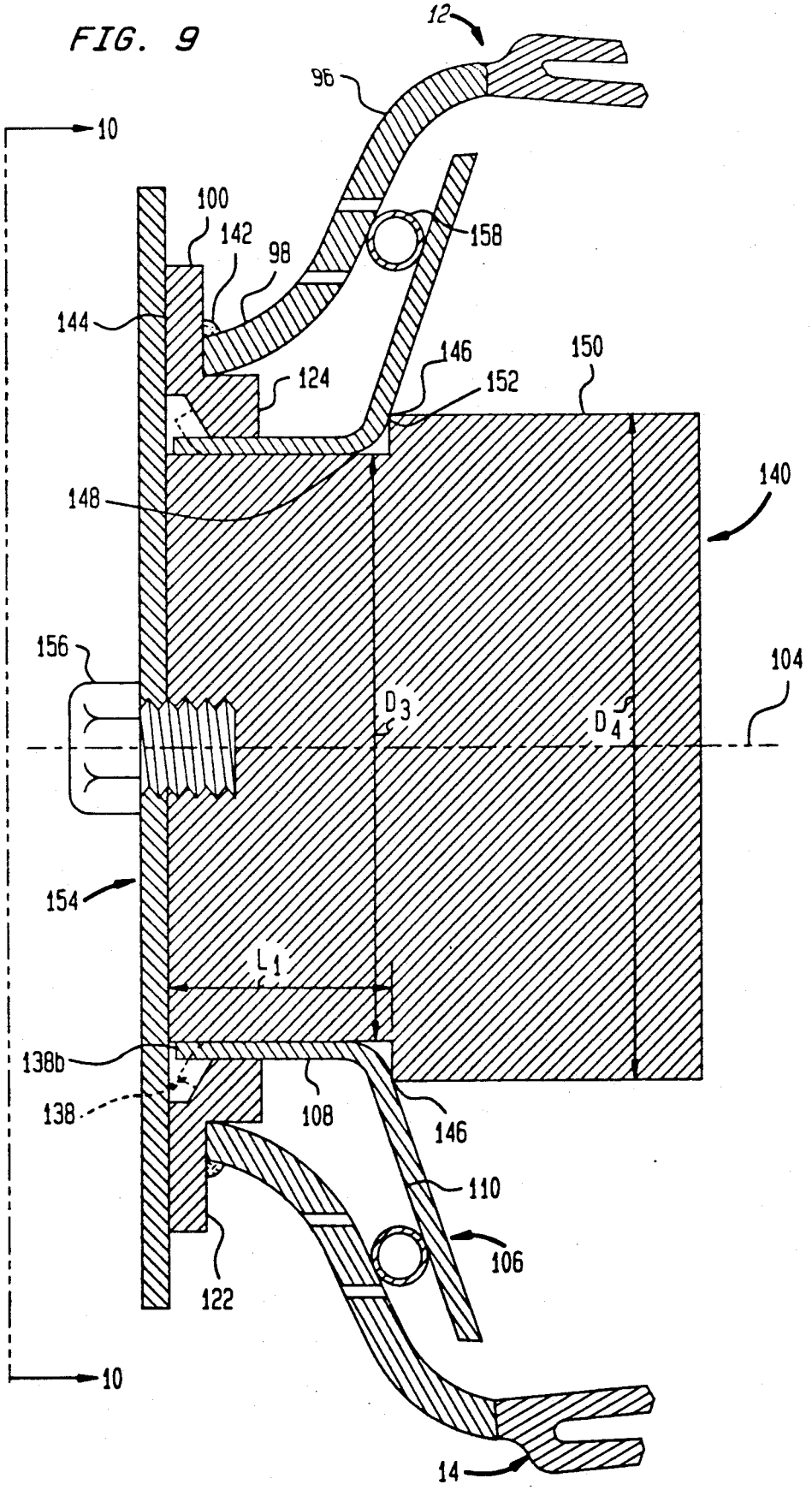
FIG. 9 is a centerline sectional view of the dome assembly illustrated in FIG. 6 showing a mounting pin for assembly of the baffle to the dome.
Figure 10:
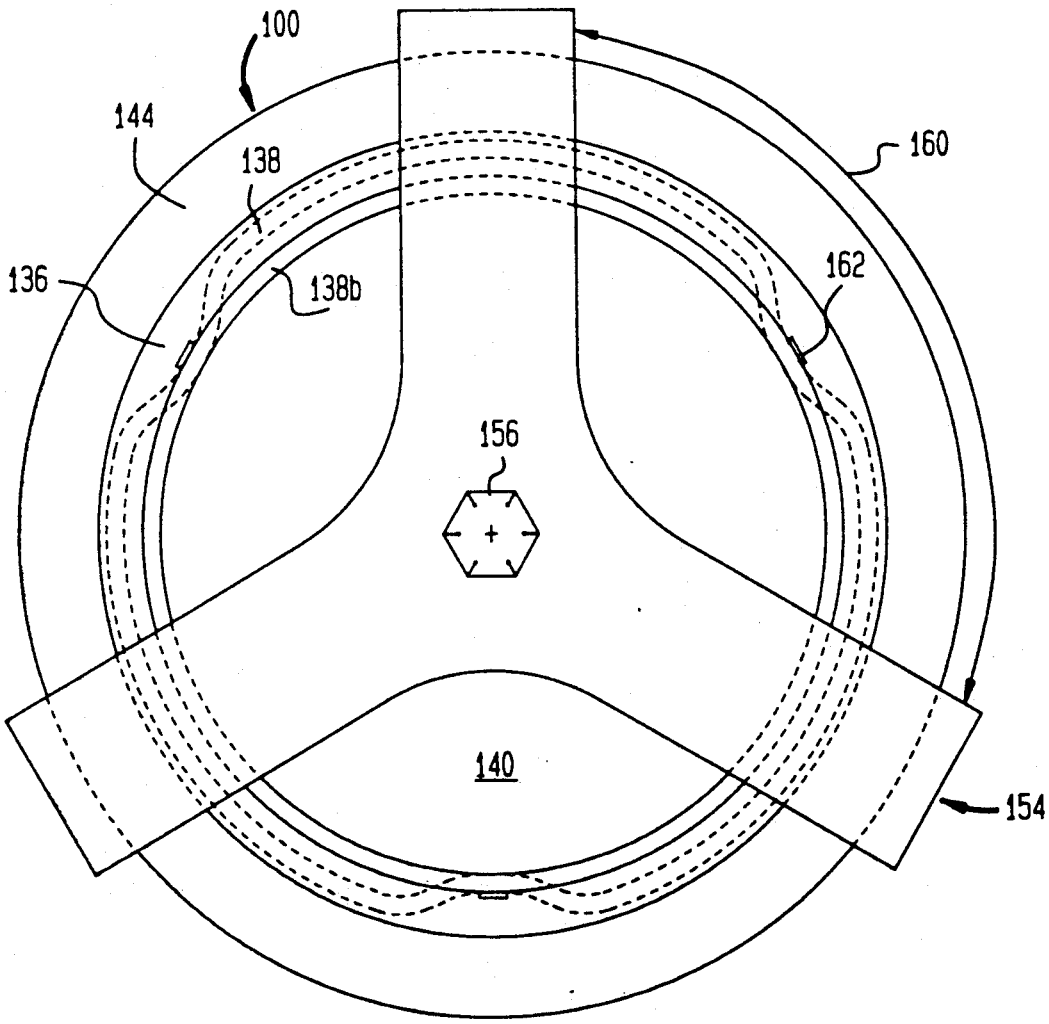
FIG. 10 is a downstream facing end view of the dome assembly illustrated in FIG. 9 taken along line 10—10.

Illustrated in FIGS. 9 and 10 is an exemplary assembly pin 140 used for assembling or mounting the baffle 106 to the mounting ring 100. During assembly, the mounting ring axial flange 124 is inserted into the dome eyelet 98 from the upstream side of the dome 96, and the ring radial flange 122 is conventionally fixedly attached to the dome 96 by welds or brazing 142. The mounting ring radial flange 122 preferably includes an annular upstream facing flat axial reference surface 144, and the baffle flare portion 110 includes a predetermined reference point 146, for example, which in the embodiment illustrated in FIG. 9 is a reference circle.

The pin 140 includes a first portion 148 having an outer diameter $D_3$ which is substantially equal to the inner diameter of the baffle mounting portion 108 so that the first portion 148 may slide through the mounting portion 108. The pin 140 further includes a second portion 150 extending from the first portion 148 and having an outer diameter $D_4$ predeterminedly greater than the diameter $D_3$ for providing a second reference point 152, or circle in this embodiment, for contacting the first reference point 146.

A three-armed positioning bracket 154 is removably attached to the pin first portion 148 by a bolt 156 threaded therethrough, for example. The bracket 154 is positioned against the axial reference surface 144 and is bolted to the pin 140 having the first portion 148 extending through the baffle 106. The first portion 148 has a predetermined axial length $L_1$ so that the baffle reference point 146 contacts the pin reference point 152 for positioning the baffle reference point 146 at the predetermined length $L_1$ relative to the axial reference surface 144. An annular tubular support ring 158 is temporarily positioned between the dome 96 and the baffle 106 for supporting the baffle flare portion 110 during assembly, and to ensure that minimal clearance is maintained between dome 96 and baffle 106 for conventional cooling of the baffle 106.

As illustrated in FIG. 10, along with FIG. 9, the three-armed bracket 154 includes three equally spaced access openings 160 which provide access to the baffle mounting portion upstream end 138 from the upstream side of the dome 96. During assembly, the mounting portion upstream end 138 is initially an undeformed cylindrical member indicated as **138*b* which extends over the recess 136. The baffle reference point 146 is maintained against the pin reference point 152 and then the mounting portion 138*b* is fixedly attached to the mounting ring 100 at a plurality of spaced tack welds 162, with three being utilized in the preferred embodiment. The tack welds 162 secure the baffle 106 at a predetermined axial relationship ($L_1$) relative to the axial reference surface 144**.

The bolt 156 is then removed from the bracket 154 and the pin 140, which are all then removed from the dome 96 along with the supporting ring 158. The mounting portion **138*b* is then conventionally bent or swaged between the tack welds 162 for extending into the recess 136 as illustrated in FIGS. 9 and 10**.

As illustrated more clearly in FIG. 8, the recess 136 is defined in part by an inclined portion **136*b* of the mounting ring axial flange inner surface 102*b* which is inclined radially outwardly and aft, with the baffle mounting portion upstream end 138 being inclined parallel to and against the recess inclined portion 136*b*. The recess inclined portion 136*b* provides a convenient anvil for swaging the mounting portion upstream end 138 thereagainst and the swaged upstream end 138 assists in fixedly securing the baffle 106 to the mounting ring 100. Since the upstream end 138 is tack welded at the three locations 162, the swaged portions of the upstream end 138 are provided only between the tack welds 162 and are circumferentially spaced around the recess 136**.

During a service operation, wherein the baffles 106 are to be replaced, the swirler 114 is first removed from the mounting ring 100, thus leaving readily accessible the baffle mounting portion upstream end 138. The three tack welds 162 may then be conventionally removed by grinding, for example, and the upstream end 138 may be conventionally unswaged for removing the baffle 106 from the mounting ring 100. A replacement baffle 106 is then inserted into the mounting ring 100 and assembled as above described. In this way, individual baffles 106 may be relatively simply replaced without substantial disassembly work or replacing the entire dome 96 as would be required in a conventional combustor wherein the baffles thereof are conventionally inaccessible from the upstream side of the dome 96. The removed swirlers 114 can then be reattached and reused for the remainder of their normal lives.

Referring again to FIG. 8, the swirler exit cone 116 further includes an annular radially outwardly extending radial flange 164 having a downstream facing axial reference surface 166 predeterminedly axially positioned relative to the cone flow surface 120, including for example its aft end being disposed at an axial length $L_2$. In particular, the baffle reference point 146 and the cone flow surface 120 are predeterminedly axially disposed relative to the ring axial reference surface 144, at the axial lengths $L_1$ and $L_2$, respectively. The exit cone 116 including the flow surface 120 and the radial flange 164 is preferably a unitary, integral member and, therefore, the flow surface 120 may be readily predeterminedly axially positioned relative to the cone axial reference surface 166 so that when the cone 116 is assembled to the mounting ring 122 a predetermined axial relationship may be maintained for reducing, if not eliminating, axial assembly stackup tolerances which would otherwise be provided by the assembly of a plurality of constituent components as is typically found in the prior art.

In this way, a predetermined spatial positioning of the flow surface 120 may be accurately maintained for all the swirlers 114 for obtaining a more uniform and consistent pattern factor. It was discovered that in scaling down the conventional low pattern factor carburetor **24*b* of FIG. 4**, manufacturing tolerances and stackup tolerances would become relatively large and thusly would create variations in spatial positioning of the dome assembly components, leading to flow variability which would have resulted in relatively high pattern factors.

In a preferred embodiment of the present invention, the mounting ring axial flange inner surface **102*b* defines a radial reference surface (102*b*) which is used for radially positioning the baffle 106 and the cone flow surface 120 in a predetermined relationship. The respective radial thicknesses of the ring axial flange 124, and baffle mounting portion 108 are predetermined so that the baffle reference point 146 and the cone flow surface 120 are predeterminedly radially disposed relative to the ring radial reference surface 102*b*. Since the mounting ring 100 is fixedly attached to the dome eyelets 98, the respective radial and axial dimensions of the ring 100, eyelet 98, and baffle 106 may be preselected so that the mounting ring radial and axial reference surfaces 102*b* and 144 are predeterminedly positioned relative to the dome eyelet 98**.

In addition to providing reference surfaces for predeterminedly positioning the baffle 10 and the flow surface 120, the mounting ring axial reference surface 144 contacts the cone axial reference surface 166, which in the preferred embodiment are machined surfaces, for forming a seal therewith for reducing leakage of the air 44 between the baffle mounting portion 108 and the exit cone 116. This is desirable since uncontrolled leakage of the air 44 therebetween affects the profile and pattern factor in the small combustor 10.

As illustrated in FIG. 8, for example, the cone flow surface 120 preferably has a transverse, axial cross section as illustrated, which includes a straight first portion 168 disposed at an aft end thereof, and a convex second portion 170 extending upstream from the first portion 168. Since the exit cone 120 is an annular member disposed coaxially about the longitudinal centerline axis 104, the straight first portion 168 defines a portion of a straight cone in revolution about the centerline 104. The second portion 170 is also annular about the centerline 104, but is convex in transverse section in a plane extending both axially and radially through the centerline 104 as illustrated in FIG. 8.

The air swirler 114 further includes an annular septum 172 disposed coaxially about the centerline 104 which has an axially extending aft portion 174 spaced radially inwardly from the exit cone 116 to define therebetween an aft venturi channel 176 for channeling swirled air 44. The cone flow surface 120 also includes a generally axially extending straight third portion 178 extending upstream from the second portion 170 and facing the septum aft portion 174. The cone flow surface second and third portions 170 and 178 are joined at a connection point 180 defining an aft venturi throat 182 producing a minimum flow area in the aft channel 176. The septum aft portion 174 includes an aft end 184, and the venturi throat 182 is preferably disposed upstream of the aft end 184. In an alternate embodiment, the aft venturi throat 182 may be disposed at the aft end 184.

The septum aft portion 174 in transverse section has a straight radially outer surface 186 and a convex radially inner surface 188, with the convex surface 188 defining a forward venturi 190 having a forward throat 192 producing a minimum flow area. The forward venturi 190 is disposed radially inwardly of the aft venturi channel 176 and is separated therefrom by the septum aft portion 174.

The septum 172 also includes a radially outwardly extending forward portion 194 spaced axially upstream from the exit cone 116, and the air swirler 114 further includes a plurality of circumferentially spaced aft swirl vanes 196 fixedly joining the septum forward portion 194 and the exit cone radial flange 164, and being integral therewith, for swirling the air 44 into the aft venturi channel 176.

As illustrated in FIG. 6, swirler 114 also includes a plurality of circumferentially spaced forward swirl vanes 198 which are slidably joined to the septum forward portion 194 for swirling the air 44 into the forward venturi 190.

More specifically, the forward swirl vanes 198 are conventionally fixedly connected to a conventional tubular ferrule 200 on an upstream side, and to a conventional tubular support plate 202 on the downstream side thereof. In the preferred embodiment, the ferrule 200, forward swirl vanes 198, and support plate 202 comprise a unitary member, which may be cast. The support plate 202 is secured in sliding engagement against the septum forward portion 194 by conventional tabs 204 which allow for radial movement of the support plate 202 relative to the centerline 104. This is effective for accommodating radial thermal expansion and contraction between the swirler 114 and the fuel injector 30. The injector 30 is conventionally slidably disposed in the ferrule 200 for similarly accommodating axial thermal differential movement.

The forward swirl vanes 198 are conventionally positioned for swirling the air 44 in a first direction, and the aft swirl vanes 196 are conventionally positioned for swirling the air 44 in a second direction opposite to the first direction as is conventionally known. The fuel 42 discharged from the fuel injector 30 during operation is injected into the forward venturi 190 wherein it is mixed with the air 44 being swirled by the forward swirl vanes 198. This initial mixture of the fuel 42 and the air 44 swirled from the forward swirl vanes 198 is discharged aft from the forward venturi 190 wherein it is mixed with the air 44 swirled by the aft swirl vanes 196 which is channeled through the aft venturi channel 176 for forming the fuel/air mixture 46. The fuel/air mixture 46 is spread radially outwardly by the centrifugal effects of the forward and aft swirlers 198 and 196 and flows along the flow surface 120 and the baffle flare portion 110 at a relatively wide discharge spray angle.

As illustrated in more particularity in FIG. 8, the flow surface convex second portion 170 has a predetermined radius $R_2$ and extends over an acute angle A for turning radially outwardly the swirled air 44 channeled through the aft venturi channel 176 by coanda forces. The coanda effect is conventionally known and the radius $R_2$ and the angle A of the convex portion 170 may be preselected for obtaining coanda turning of the air 44. The convex second portion 170 preferably includes two axially spaced circumferentially extending generally V-shaped recesses 206. It has been discovered that these recesses 206 provide flow stability and enhance turning of the air 44 and the fuel/air mixture 46 radially outwardly along the convex second portion 170, the first portion 168 and the baffle flare portion 110. In the preferred embodiment, the recesses 206, or steps, are about 10 mils deep with the aft step disposed at the juncture with the flow surface first portion 168 and the forward step being generally positioned in the middle of the convex portion 170. The relative positions of the recesses 206 in the convex portion 170 are preselected based on analysis and testing for individual applications for enhancing the turning force, and coanda effect on the air 44 and the fuel/air mixture 46 over the exit cone flow surface 120. Accordingly, the acute angle A may approach 90° while still maintaining attached flow, and in the preferred embodiment is about 70°.

The straight, conical flow surface first portion 168 is preferably provided for maintaining flow attachment thereto and stabilizing the flow. Also in the preferred embodiment, the first portion 168 is aligned coextensively with the baffle flare portion 110 for enhancing flow stability and maintaining a relatively wide discharge spray angle of the fuel/air mixture 46.

In the preferred embodiment, the flow surface first portion 168 and the baffle flare portion 110 form a portion of a straight cone and are inclined at the acute angle A in an aft direction relative to the centerline axis 104 for providing a relatively wide discharge spray angle and for maintaining a relatively low pattern factor. In the preferred embodiment, since the exit cone 116 and the baffle 106 are separate elements, which must be suitably blended together, the flow surface first portion 168 is spaced from the baffle flare portion 110 by a notch 208.

More specifically, the baffle flare portion 110 is joined to the baffle forward mounting portion 108 by an arcuate transition portion 210 which forms the notch 208 when the baffle 106 is positioned adjacent to the exit cone 116. In an alternate embodiment, the notch 208 could be eliminated for providing a substantially continuous flow surface from the first portion 168 to the flare portion 110. In alternative embodiments, the inclination of the flow surface first portion 168 may instead of being coextensive with the flare portion 110 be disposed at a shallow intercept with the flare portion 110, which may be obtained by reducing the value of the angle A for the first portion 168. Such shallow intercept, or coextensive relationship, of the first portion 168 to the flare portion 110 is preferred for maintaining flow attachment.

The dome assembly 94 as above described results in improved serviceability for both assembly, and disassembly for replacement of life-limiting parts; and, also reduces manufacturing tolerances and stackup tolerances for reducing flow variations leading to variations in pattern factor. As a result, a substantially low pattern factor was obtained for the combustor illustrated in FIG. 5, which is substantially less than the first reference pattern factor for the identical combustor, but for the dome assembly 94, illustrated in FIG. 1. The pattern factor was also lower than the second reference pattern factor.

Improved serviceability and reduced pattern factor are two interrelated benefits obtained from the improved dome assembly 94 in accordance with the present invention. Both the baffle flare portion 110 and the flow surface 120 are preferably located relative to the axial reference surface 144 of the mounting ring 100 which improves the spatial relationship therebetween. Since the axial reference surface 144 is preferably a machined surface, it provides a more accurate reference than conventional sheet metal surfaces in a conventional dome.

Furthermore, since the axial reference surface 144 of the mounting ring 100 and the axial reference surface 166 of the exit cone 116 are machined surfaces, they provide an effective seal which reduces leakage of the air 44 between the outer surface 118 and the inner surface 134, which leakage through the notch 208 would affect the pattern factor in the event of excessive leakage in a small combustor.

As described above, the mounting ring 100 provides both an accurate reference member for controlling spatial positions of the separate components, as well as allows for relatively easy replacement of individual baffles 106 without the need for replacing the entire dome or without substantial disassembly work. More specifically, the swirler 114 is fixedly secured to the mounting ring 100 by a plurality of circumferentially spaced tack welds 212 as illustrated in FIGS. 6 and 8, for example, which welds 212 may be relatively easily ground away for removing the swirler 114 when desired. Access to the baffle mounting portion 108 is then provided from the upstream side of the dome 96 as described above, and the baffle 106 may be relatively easily removed and replaced as above described. The replaced baffle 106 is then relatively easily positioned relative to the axial reference surface 144, which is similarly true for the flow surface 120 of the swirler 114 when reassembled to the mounting ring 100.

The above described advantages of the dome assembly 94 in accordance with the present invention result also in desirable starting ability of the combustor 10, combustion stability, shell durability, carbon and coking resistance, as well as insensitivity to assembly tolerance stackup for the embodiment built and tested.

Also as described above, maximum turning of the air 44 over the flow surface 120 can be obtained by utilizing the coanda effect. Also in the preferred embodiment, by disposing the connection point 180 upstream of the septum aft end 184, mixing between the fuel/air mixture 46 channeled through the forward venturi 190 and the air 44 from the aft venturi channel 176 is delayed past the initiation of flow turning around the convex second portion 170. This is done because mixing reduces the ability of the flow stream to initiate and continue turning.

The swirler 114 in accordance with the preferred embodiment thus allows the discharge spray of the fuel/air mixture 46 to be substantially independent of the performance of fuel injector 30. A relatively narrow spray angle of the fuel 42 from the fuel injector 30 can be turned into a relatively wide atomized spray at the exit cone 120 and the baffle flare portion 110. Accordingly, the fuel injector 30 may be predeterminedly retracted slightly upstream from an aft end of the ferrule 200, as shown in FIG. 6, to reduce or prevent injector varnishing while at the same time reducing injector spray impingement of the fuel 42 on the forward venturi 190 which leads to carbon buildup thereon during combustor operation.

Furthermore, by maintaining attached flow on the face of the baffle flare portion 110, lower baffle temperatures and reduced combustor liner thermal distress are obtained for improving combustor life.

Yet further, the relatively wide spray discharge from the swirlers 114 allows for a reduction in the number of carburetors 112 utilized around the circumference of the dome 96.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention. For example, other types of swirlers could be used, including axial swirl vanes instead of radial swirl vanes.

Accordingly, what is desired to be secured by Letters Patent of the United States is the invention as defined and differentiated in the following claims:

We claim:

1. A dome assembly for a gas turbine engine combustor comprising:

an annular dome having at least one dome eyelet;

a mounting ring fixedly joined to said dome and having a radially inner surface defining a central aperture coaxially aligned with said dome eyelet;

a baffle having a tubular mounting portion extending upstream through said mounting ring central aperture and fixedly joined to said mounting ring radially inner surface, and a flare portion extending downstream from said mounting ring; and a carburetor including an air swirler having an annular exit cone, said exit cone having a radially outer surface disposed against said baffle mounting portion, an annular radially outwardly extending radial flange, and a radially inwardly facing annular flow surface for channeling air thereover and downstream over said baffle flare portion;

said swirler exit cone radial flange being fixedly joined to, and removable from, said mounting ring for providing a fuel/air mixture through said central aperture with a predetermined relationship to said baffle flare portion, said baffle mounting portion extending upstream through said mounting ring central aperture for being accessible from an upstream side of said dome upon removal of said carburetor from said mounting ring.

2. A dome assembly according to claim 1 wherein:

said dome eyelet includes a radial side surface, and an axial inner surface defining an eyelet opening;

said mounting ring further includes an annular radially outwardly extending radial flange fixedly joined to said dome around said dome eyelet and an annular axial flange extending downstream therefrom and through said dome eyelet opening, said axial flange having said mounting ring radially inner surface defining said central aperture; and said baffle mounting portion having an annular radially outer surface fixedly connected to said mounting ring radially inner surface, and further having a radially inner surface disposed against said exit cone outer surface.

3. A dome assembly according to claim 3 wherein said mounting ring further includes an annular recess extending radially outwardly at a juncture of said mounting ring radial and axial flanges; and said baffle mounting portion has an upstream end inclined radially outwardly into said recess for joining said baffle to said mounting ring.

4. A dome assembly according to claim 3 further including a plurality of circumferentially spaced welds joining said baffle mounting portion upstream end in said recess.

5. A dome assembly according to claim 3 wherein said recess is defined in part by an inclined portion of said mounting ring radially inner surface inclined radially outwardly and aft, and said baffle mounting portion upstream end is inclined parallel to said recess inclined portion.

6. A dome assembly according to claim 5 wherein said baffle mounting portion upstream end is inclined parallel to said recess at only a plurality of locations spaced circumferentially around said recess.

7. A dome assembly according to claim 6 further including a plurality of circumferentially spaced welds joining said baffle mounting portion upstream end in said recess.

8. A dome assembly according to claim 2 wherein:

said mounting ring radial flange includes an annular upstream-facing axial reference surface;

said swirler exit cone radial flange has a downstream-facing axial reference surface predeterminedly positioned relative to said exit cone flow surface;

said baffle includes a predetermined reference point; and said baffle reference point and said cone flow surface are predeterminedly axially disposed relative to said mounting ring axial reference surface.

9. A dome assembly according to claim 8 wherein:

said mounting ring radially inner surface defines a radial reference surface; and said baffle reference point and said exit cone flow surface are predeterminedly radially disposed relative to said mounting ring radial reference surface.

10. A dome assembly according to claim 9 wherein said mounting ring radial and axial reference surfaces are predeterminedly positioned relative to said dome eyelet.

11. A dome assembly according to claim 9 wherein said mounting ring axial reference surface contacts said exit cone axial reference surface for forming a seal for reducing leakage of air between said baffle mounting portion and said exit cone.

12. A dome assembly according to claim 2 wherein said exit cone flow surface has a transverse axial cross section including:

a straight first portion disposed at an aft end thereof; and a convex second portion extending upstream from said first portion.

13. A dome assembly according to claim 12 wherein:

said air swirler further includes an annular septum having an axially extending aft portion spaced radially inwardly from said exit cone to define therebetween an aft venturi channel for channeling swirled air; and said exit cone flow surface further includes a third portion extending upstream from said second portion and facing said septum aft portion.

14. A dome assembly according to claim 13 wherein:

said septum aft portion includes an aft end; and said exit cone flow surface second and third portions are joined at a connection point defining with said septum aft portion an aft venturi throat having a minimum flow area in said aft channel.

15. A dome assembly according to claim 14 wherein said aft venturi throat is disposed at said septum aft portion aft end.

16. A dome assembly according to claim 14 wherein said aft venturi throat is disposed upstream of said septum aft portion aft end.

17. A dome assembly according to claim 14 wherein said septum aft portion in transverse section has a straight radially outer surface and a convex radially inner surface, said convex surface defining a forward venturi having a forward throat of minimum flow area.

18. A dome assembly according to claim 17 wherein said septum further includes a radially outwardly extending forward potion spaced from said exit cone; and said air swirler further includes a plurality of circumferentially spaced aft swirl vanes fixedly joining said septum forward portion and said exit cone for swirling air into said aft venturi channel.

19. A dome assembly according to claim 18 wherein said air swirler further includes a plurality of circumferentially spaced forward swirl vanes slidably joined to said septum forward portion for swirling air into said forward venturi.

20. A dome assembly according to claim 19 wherein said forward swirl vanes are positioned for swirling air in a first direction, and said aft swirl vanes are positioned for swirling air in a second direction opposite to said first direction.

21. A dome assembly according to claim 18 wherein said exit cone, septum, and aft swirl vanes of said air swirler are integral with each other, and said swirler is removable from said mounting ring.

22. A dome assembly according to claim 14 wherein said exit cone flow surface second portion has a predetermined radius for turning said swirled air radially outwardly from said aft venturi channel by coanda forces.

23. A dome assembly according to claim 22 wherein said exit cone flow surface second portion includes a circumferentially extending generally V-shaped recess.

24. A dome assembly according to claim 22 wherein said exit cone flow surface second portion includes two axially spaced circumferentially extending generally V-shaped recesses.

25. A dome assembly according to claim 24 wherein said exit cone flow surface first portion is aligned coextensively with said baffle flare portion.

26. A dome assembly according to claim 25 wherein said exit cone flow surface first portion is spaced from said baffle flare portion.

27. A dome assembly according to claim 25 wherein said baffle flare portion is joined to said baffle mounting portion by an arcuate transition portion forming a notch between said exit cone flow surface first portion and said baffle flare portion.

28. A dome assembly according to claim 25 wherein said exit cone flow surface first portion and said baffle flare portion form a portion of a straight cone and are inclined at an acute angle in an aft direction relative to a centerline axis of said exit cone.

29. A dome assembly according to claim 28 wherein said acute angle is about 70°.

* * * * *